United States Patent [19]

Mahyera et al.

[11] 4,240,664

[45] Dec. 23, 1980

[54] HYDRAULIC JET CUTTING TOOL AND METHOD

[75] Inventors: Anil Mahyera, New Dundee; John Duff, North Bay, both of Canada

[73] Assignee: Joy Manufacturing Company, Pittsburgh, Pa.

[21] Appl. No.: 940,803

[22] Filed: Sep. 8, 1978

[51] Int. Cl.[3] ..... E21C 25/60

[52] U.S. Cl. ..... 299/17; 299/34; 239/550; 239/556

[58] Field of Search ..... 239/548, 550, 554, 556, 239/567; 175/67, 422; 299/17, 34

[56] References Cited

U.S. PATENT DOCUMENTS

| | | | |
|---|---|---|---|
| 1,068,933 | 7/1913 | Sackett | 37/63 |
| 2,125,740 | 8/1938 | Schacht | 37/62 |
| 2,203,796 | 6/1940 | O'Neill . | |
| 3,203,736 | 8/1965 | Andersen | 299/17 |
| 3,262,508 | 7/1966 | Price | 175/207 |
| 3,324,957 | 6/1967 | Goodwin et al. | 175/67 |
| 3,326,607 | 6/1967 | Book | 299/58 |
| 3,384,192 | 5/1968 | Goodwin et al. | 175/422 |
| 3,402,780 | 9/1968 | Goodwin et al. | 175/67 |
| 3,554,602 | 1/1971 | Chaney | 175/67 X |
| 3,572,839 | 3/1971 | Okabe | 299/17 |
| 3,796,371 | 3/1974 | Taylor et al. | 239/101 |
| 3,960,407 | 6/1976 | Noren | 299/17 |
| 4,111,490 | 9/1978 | Liesveld | 299/17 |

*Primary Examiner*—Robert W. Saifer
*Attorney, Agent, or Firm*—J. Stewart Brams

[57] ABSTRACT

An improved hydraulic jet impingement cutting apparatus and method for cutting kerfs in rock or other hard formations by provision of divergent hydraulic jets in a cutter implement which cut clearance for passage of the implement into the kerf being cut.

31 Claims, 10 Drawing Figures

HYDRAULIC JET CUTTING TOOL AND METHOD

In the art of rock cutting or cutting of other hard formations or bedded material such as often may be necessary in mining, it is well known to utilize hydraulic jet impingement cutting devices typically including one or more jet nozzles or orifices arranged to direct high velocity jets of a fluid cutting medium against the rock surface to free material therefrom by abrasion or erosion such as shown in U.S. Pat. No. 3,796,371, for example. Although prior hydraulic jet impingement cutting devices have generally served their intended purposes, some have nevertheless been subject to deficiencies relating to structural complexity, operational convenience and operating economy. For example, many prior hydraulic jet cutters have been effective for rock cutting only in conjunction with use of an abrasive-bearing liquid cutting medium which tends to erode the flow passages, nozzles and orifices of the cutting device through which it flows. Other prior hydraulic jet cutting devices have been quite large and cumbersome, and therefore unable to conveniently cut clearance for passage of their own structure through or into the confines of the kerf being cut. This is very important inasmuch as it often is highly desirable to have the capability to cut relatively deep kerfs and this requires that the jet cutter device be able to pass into the kerf. Without this capability the standoff distance between the jet cutter device and the work surface (i.e. the kerf bottom) will progressively increase as cutting proceeds and ultimately will exceed a maximum standoff distance beyond which the cutting effectiveness is seriously curtailed. The alternative in the prior art has been to cut a kerf wide enough to receive the cutter assembly thereinto so that a proper standoff distance or separation could be maintained in cutting the deeper kerfs. This, however, is an inefficient practice inasmuch as the wider cut requires substantial additional energy input with no direct benefit in overall productivity. Thus, the desired ability to efficiently cut narrow, deep kerfs conflicts directly with prior technology which permitted only relatively shallow, narrow kerfs to be cut in an energy efficient manner. Deeper kerfs were required to be much wider than otherwise necessary solely to allow the cutter to pass.

Additionally, some prior jet cutter devices, especially those of the pulse jet type have been structurally and operationally complex.

These and other deficiencies of prior hydraulic jet kerf cutters are overcome by the present invention which provides an improved jet impingement cutter and method including in one embodiment thereof a generally elongated nozzle housing with longitudinally spaced apart and transversely directed jet nozzles therein. The cutter of this invention is particularly well adapted for cutting kerfs in hard formations such as rock. It is compact and simple in design and structure, and is operable according to an improved method to cut its own clearance even in deep, narrow kerfs.

These and other objects and advantages of the present invention are more fully specified in the following description which refers to the accompanying figures, in which:

FIG. 1 is a side elevation of one embodiment of a jet impingement cutter of the present invention;

FIG. 2 includes a fragmentary portion of FIG. 1 showing an alternate embodiment of the structure of FIG. 1;

Figure 3:
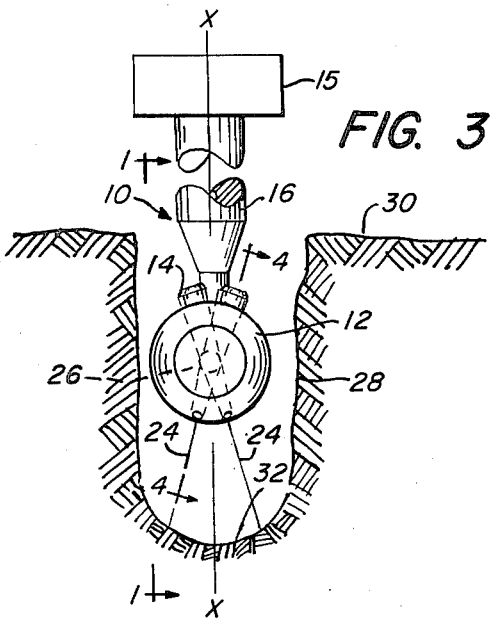
FIG. 3 is an end elevation taken on line 3—3 of FIG. 1.
Figure 8A:
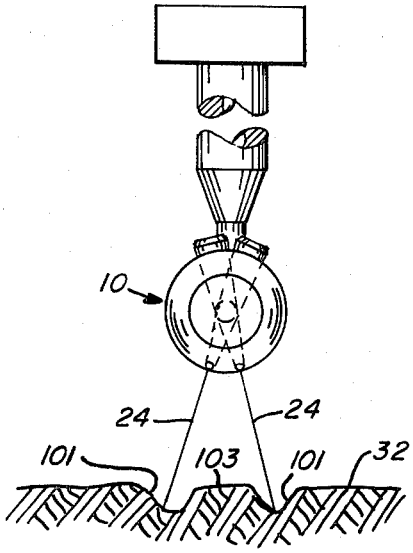
Figure 8B:
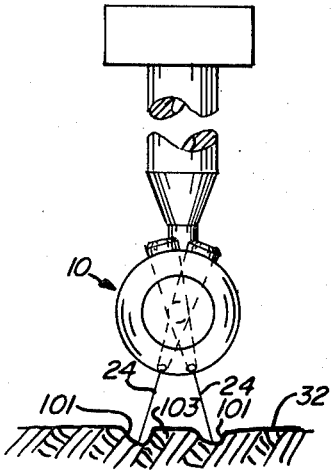
Figure 9:
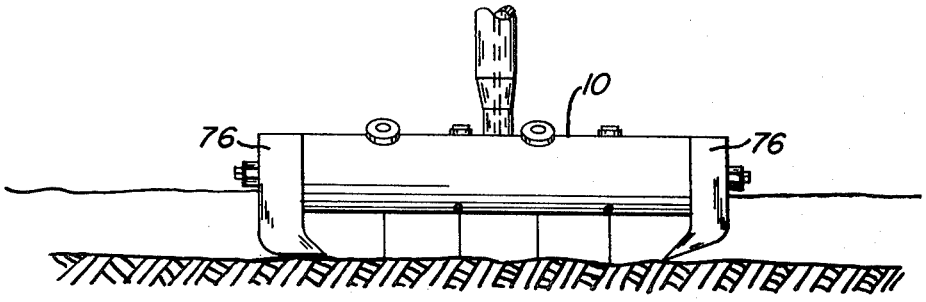

FIGS. 8*a* and 8*b* are schematic representations similar to FIG. 3 and showing operational characteristics of the invention; and FIG. 9 is a side elevation of an alternate embodiment of the instant invention.

Figure 1:
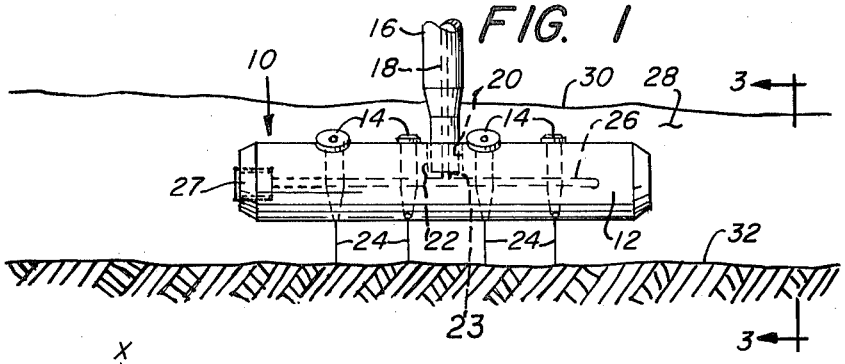
Figure 2:
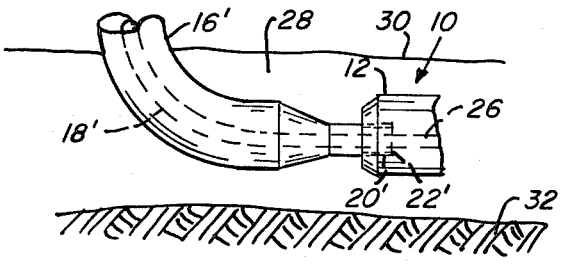

There is generally indicated at 10 in FIGS. 1, 2 and 3 a hydraulic jet impingement cutter constructed according to the principles of the present invention and shown in the process of cutting a kerf 28 in a hard formation 30, rock for example. Of course it is to be understood from the outset that the illustrated embodiments of cutter 10 are merely representative of many possible forms thereof and are shown herein in simplified form solely for purposes of clarity. Such simplification is not intended to unduly limit the scope of the invention described.

Accordingly, as shown in FIGS. 1-3 cutter 10 comprises a generally cylindrical and elongated nozzle portion in the form of a rigid body member 12 formed from any suitable material such as steel and including a plurality of longitudinally spaced apart jet nozzles 14 extending generally transversely therewithin. A rigid tool supporting member 16 affixed rigidly and releasably intermediate the axial ends of body 12 is carried by any suitable articulated or movable tool support means (schematically shown at 15 in FIG. 3) and adapted to support the cutter 10 during cutting operations. The nozzles 14 direct high velocity, preferably continuous flow, jets 24 of the cutting medium generally transversely and radially outward of body 12 to impinge upon the work surface, shown as a generally lower extent 32 of kerf 28 to free material therefrom by abrasion or erosion. It is believed the cutting action of the jets is produced as the individual liquid jets penetrate between the rock crystals, and the cutting rate per unit of energy input is thus related to the porosity of the rock being cut, and to the ability of the liquid jet to penetrate the rock. Thus, it is desirable that the jet cutter be located within a specific maximum standoff distance for effective cutting depending upon the parameters of the liquid jet produced thereby, for example, jet velocity, liquid supply pressure and jet orifice diameter.

In practice of the improved method, the cutting action of jets 24 initiates and then progressively deepens kerf 28 as cutter 10 is traversed repeatedly through a path extending axially thereof within plane X—X and generally parallel to and adjacent work surface 32. With each succeeding pass the cutter 10 may be lowered incrementally into kerf 28 to maintain conformance with predetermined standoff distance requirements as described above to promote efficient cutting action.

As shown, support 16 may be of a generally thick walled, elongated tubular configuration having an elongated passage 18 extending axially therewithin for delivery of a fluid cutting medium to nozzles 14, water for example, from any suitable source of high pressure flow such as a suitable pump (not shown). Accordingly, one end of support 16 is suitably sealingly secured, as by external threads 20 formed thereon, within a cooperably threaded, generally radially extending stepped bore 22 formed within body 12 intermediate the axial ends thereof. A reduced diameter portion 23 of bore 22 communicates in fluid flow conducting relation with a closed interior passage 26 that extends longitudinally within body 12 and in turn communicates with each nozzle 14 whereby pressurized fluid cutting medium may be directed via passage 18, bore 23 and passage 26 into each nozzle 14.

In the embodiment of FIG. 1 passage 26 is formed as a blind bore extending from one axial end of body 12 and having a suitable plug 27 sealingly secured within the open end thereof. In an alternative embodiment as shown in FIG. 2 a cutter support 16' is secured as by mating threads 20', 22' within the open end of passage 26 in lieu of plug 27 whereby body 12 is supported by the support 16' extending axially endwise thereof and the pressurized fluid cutting medium is conducted to nozzles 14 by way of a passage 18' and passage 26.

As shown in FIG. 3, selected nozzles 14 preferably are disposed so as to direct jets 24 in angularly spaced directions with respect to each other. For example, selected adjacent ones of nozzles 14 may be oriented such that the respective jets 24 diverge radially from a central longitudinal plane X—X of body 12. Such positioning of nozzles 14 provides for cutting of clearance for cutter 10 whereby the cutter 10 may be advanced into kerf 28 as cutting progresses. Additionally the divergence of the paths of jets 24 permits control of kerf width through control of the standoff distance between the work surface 32 and the outlets of nozzles 14 as described hereinbelow.

The jets 24 shown as emanating from nozzles 14 in FIGS. 1 and 3 need not be the sole means operable to cut the kerf 28. for example, additional nozzles 14 may be provided to cut out the area of surface 32 intermediate the illustrated jets, or a mechanical cutting implement (to be described hereinbelow) may be employed in conjunction with jets 24.

Figure 4:
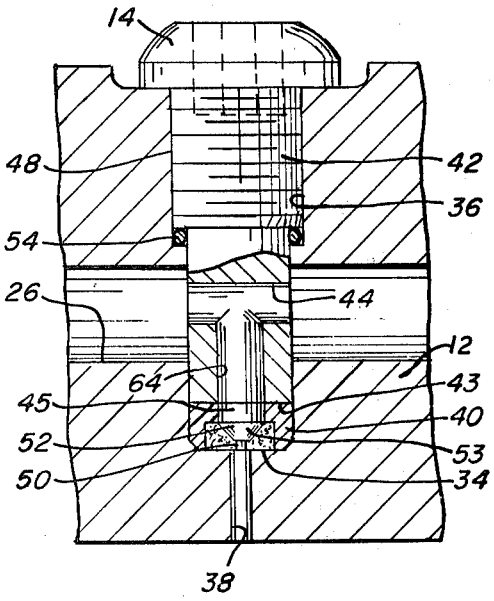
FIG. 4 is a transverse section taken on line 4—4 of FIG. 3 and showing one jet nozzle arrangement.

In FIG. 4 is shown one preferred arrangement of a nozzle assembly 14 wherein a stepped through bore 36 extends generally radially within body 12 with respect to the longitudinal axis thereof and intersects bore 26. An orifice member 34, formed from any suitably hard and wear resistent material, is carried within bore 36 intermediate the intersection of bores 36, 26 and a reduced diameter outlet portion 38 of bore 36. A generally annular packing 40, formed from any suitably pliable material, sealingly engages orifice member 34, preferably in a manner to locate member 34 coaxially within bore 36. Orifice member 34 includes a through passage 53 which communicates in coaxially aligned, fluid flow conducting relation with bore portion 38 and is comprised of a generally conical passage portion 52 which converges toward and communicates with one end of an orifice passage 50, which passage 50 in turn communicates adjacent the opposite end thereof with bore portion 38. Passage 50 is preferably of smaller cross sectional area than bore portion 38 and is coaxially aligned therewith. Accordingly, high pressure fluid flow through the restricted orifice 50 will produce a high velocity jet which, being of smaller cross section than bore portion 38 and flowing coaxially therewith will pass unobstructed through bore portion 38 to forcefully impinge upon work surface 32 to abrade or erode material therefrom.

A bolt 42 is threadingly received within an enlarged diameter, internally threaded portion 48 of bore 36 such that an end surface 43 thereof bears upon packing 40 to rigidly, sealingly clamp packing 40 and orifice member 34 in place. The threaded engagement of bolt 42 within bore portion 48 is sealed by any suitable commercially available thread sealing substance, or alternatively by a suitable seal such as annular seal member 54 which encompasses bolt 42 and is retained within bore portion 48 in sealing engagement with adjacent shoulder portions of bolt 42 and bore portion 48. Mechanical deformation of packing 40 upon tightening of bolt 42 serves to seal all interfaces abutted by the packing 40 including external peripheral portions of orifice member 34.

To accomodate flow of the cutting medium from passage 26 to nozzle outlet passage 50, bolt 42 has passage means including one or more transversely extending through passages 44 which communicate in fluid flow conducting relation with passage 26. Also within bolt 42 an axially extending passage 64 communicates between passages 44 and conical passage portion 52 by way of a coaxial through opening 45 in packing 40.

Figure 5:
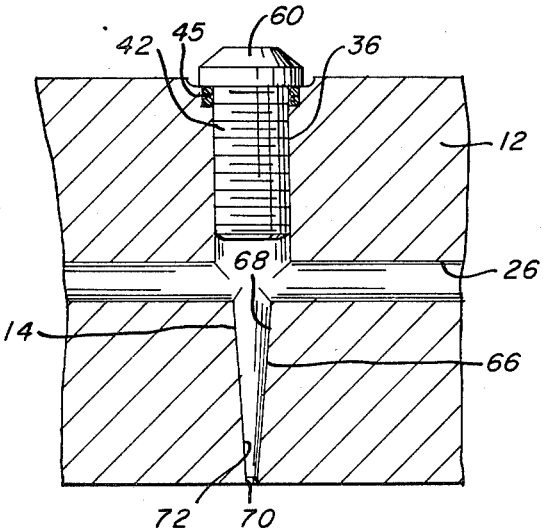
FIG. 5 is a transverse section on the same plane as FIG. 4 showing an alternative jet nozzle arrangement.

In FIG. 5 there is shown an alternate arrangement of nozzle 14 wherein bore 36 is provided for access to permit use of any suitable metal working means to form a conical, radially extending, converging orifice passage 66 within body 12. Passage 66 includes cross sectionally larger inner end portion 68 which communicates with passage 26, and a cross sectionally smaller outer end portion 72 which communicates with a reduced diameter outlet orifice 70. Orifice 70 communicates between passage 66 and the exterior of body 12 whereby pressurized fluid flow therethrough from passage 26 forms a high velocity jet of cutting medium oriented and directed in much the same manner as described hereinabove. Bolt 42 is provided to seal the access end of the bore 36 from the atmosphere. Also shown in FIG. 5 is an alternative sealing arrangement for bolt 42 wherein a suitable sealing member such as an O-ring seal 45 encompassing bolt 42 is retained adjacent the radially outer end of the access poriton of bore 36 by bolt head 60 to seal in much the same manner as described for seal 54 hereinabove.

Figure 6:
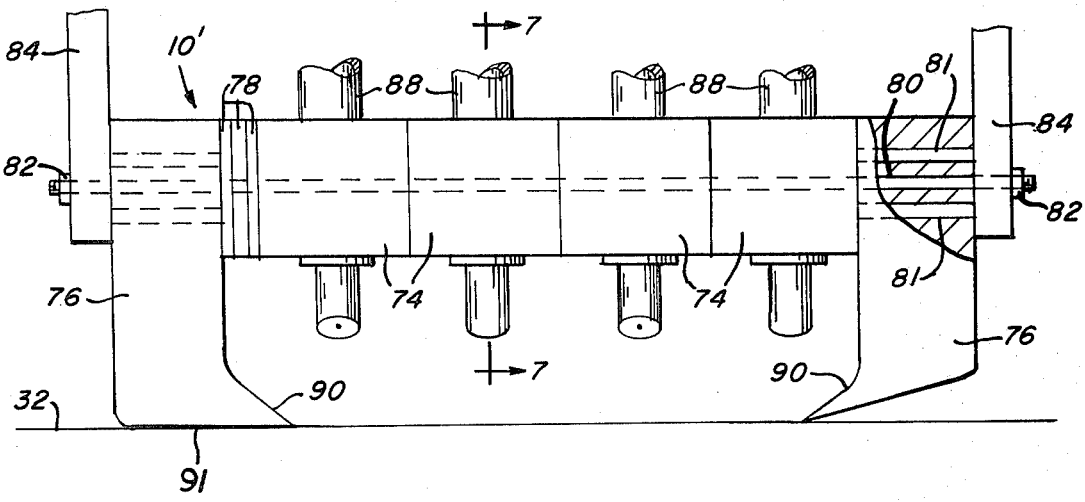
FIG. 6 is a side elevation of an alternative embodiment of the present invention.
Figure 7:
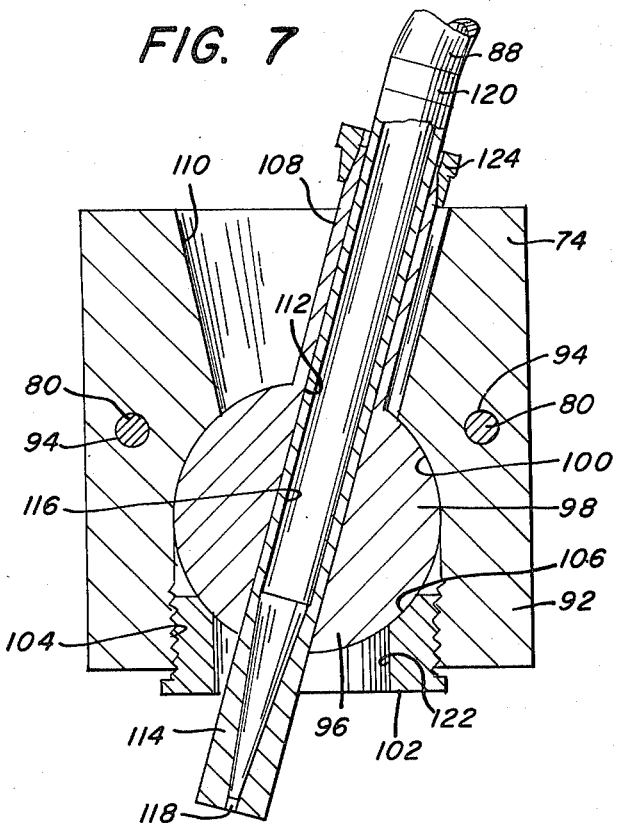
FIG. 7 is a transverse section taken on line 7—7 of FIG. 6 and showing one jet nozzle arrangement for the embodiment of FIG. 6.

In FIGS. 6 and 7, there is shown an alternative embodiment of the present invention wherein a cutter assembly 10' includes a plurality of independently adjustable nozzle assemblies 74 and may include mechanical cutter bits 76, all positioned in longitudinal alignment and adjacent each other or with spacer plates 78 inserted intermediate adjacent elements 74 and/or 76 for additional spacing therebetween as desired according to the desired operating characteristics of the apparatus. The described elements 74, 76 and 78 are releasably secured together by any suitable means, for example, elongated tie rods 80 which pass therethrough and have threaded nuts 82 engaging cooperably threaded, longitudinally opposed ends thereof. Tie rods 80 may also serve to secure assembly 10' to any suitable tool support, for example, support bracket portions 84 retained intermediate respective nuts 82 and bits 76 adjacent the opposed ends of assembly 10'.

As shown in FIGS. 6 and 7, assembly 10' includes four nozzle assemblies 74 carried intermediate two cutter bits 76, although it will be evident that more or fewer bits 76 and nozzles 74 may be used. Each cutter bit 76 includes a cutting edge portion 90 suitable for attacking the work surface to free material therefrom by mechanically gouging or tearing away material not removed by the action of the fluid cutting medium. For example, according to the improved method, nozzle assemblies 74 may be positioned for cutting plural, generally parallel channels in work surface 32 as assembly 10' is passed thereover whereby the trailing bit 76 will disintegrate the intervening ridges to complete the cut. When assembly 10' is traversed through the cutting path in the opposite direction the bit 76 adjacent the opposed end thereof disintegrates the intervening ridges. During a pass of assembly 10' over work surface 32 the forward bit 76 (i.e. the bit not being utilized for cutting) may be employed as a guard to protect nozzles 74 from damage, as a scraper to remove debris from the path of travel of the cutter assembly 10. or as a guide to provide the proper standoff distance from work surface 32 for efficient hydraulic jet impingement cutting action.

If bit 76 is to function primarily as scraper or standoff guide it may be formed to include an enlarged base portion 91 adjacent to the cutting edge portion 90 as shown at the left in FIG. 6. If the bit 76 is to function primarily as a cutter with only secondary functions as a scraper or standoff guide, the cutting edge 90 will be formed for more effective cutting as by protruding downwardly, as shown at the right in FIG. 6. To provide an adjustable standoff, each bit 76 includes plural, vertically spaced bores 81 and tie rods 80 may be passed through the selected bores 81 at the time of assembly according to the standoff distance desired. Of course, a much more practical arrangement would include actuable means for providing incremental adjustment of the standoff through adjustment of bits 76 within a range of vertical movement without disassembly of the cutter assembly 10'. It will be further appreciated that cutter bits 76 may be employed in conjunction with the cutter assembly 10 of FIGS. 1–3 as shown in FIG. 9, for example.

It will be appreciated that the resistance to movement of the assembly 10 through each traverse of a kerf is much greater if cutter bits 76 are used than if no cutter bits are used. Accordingly, the particular design parameters of the support and traversing drive structures will depend in large part upon the stresses to be imposed thereon in operation.

In FIG. 7, a nozzle assembly 74 is shown as including a rigid body member 92 having laterally spaced and horizontally extending through bores 94 adapted to receive tie rods 80 and further including means for adjustably retaining a nozzle unit 96. Nozzle unit 96 includes a generally spherical portion 98 which is adjustably retained within a downwardly opening socket 100 formed internally of body 92. A threaded clamping nut 102 is adapted to be engaged within a cooperably threaded bore 104 which extends downwardly from socket portion 100 and opens to the lower side of body 92. Clamping nut 102 includes a generally spherical annular portion 106 which is adapted to engage spherical portion 98 whereby tightening of nut 102 rigidly clamps nozzle unit 96 within socket 100.

As shown, nozzle unit 96 also includes a generally elongated portion 108 which extends radially outwardly of spherical portion 98 and within a generally conical cavity 110 which diverges upwardly and outwardly within body 92 from socket portion 100 to the upper side of body 92. A through bore 112 extends axially within elongated portion 108 and through spherical portion 98 and is adapted to slidably receive therewithin an elongated tubular orifice member 114 which is of sufficient length to project outwardly of both ends of bore 112 and in practice projects downwardly through an interior peripheral opening 122 in nut 102. Orifice member 114 includes an axially extending passage 116 that converges toward the lower axial end thereof to form an outlet orifice 118 adjacent the lower axial end thereof. A suitable fluid connection 120 (e.g. standard hardware fittings) connects orifice member 114 with supply conduit 88 for fluid flow from supply conduit 88 to orifice 118 by way of passage 116.

Each orifice member 114 may be moved upwardly or downwardly to individually adjust the standoff distance and the desired adjustment thereof may be maintained by any suitable securing means such as an annular clamping nut 124 threadingly engaging the upper end of elongated portion 108 to clamp member 114 therewithin, for example, in much the same manner as a standard compression pipe fitting. Additionally, it will be seen that the direction and angle of incidence to work surface 32 of the jet 24 emitted from orifice 118 may be adjusted within the limits of movement of portion 108 within conical cavity 110 and such direction or angle may be securely maintained by the hereinabove described clamping action of nut 102.

FIGS. 8*a* and 8*b* illustrate some of the advantageous features of the method and apparatus hereinabove disclosed. From FIG. 8*a* the manner in which cutter 10 erodes material from work surface 32 may be seen in the formation of channels 101 by the diverging jets 24. Other jets (not shown) may be employed to erode material from a ridge or rise 103 which is left between channels 101. Alternately or additionally, a mechanical cutter bit such as that described hereinabove in conjunction with the embodiment of the FIGS. 6 and 7 may be employed to remove such ridges 103. In FIG. 8*b* the assembly 10 is shown at a standoff distance smaller than that of FIG. 8*a*. It will be noted that the lateral separation of channels 101 is smaller for a lesser standoff distance such that ridge 103 therebetween is laterally smaller also. Thus, according to the present invention the divergent jets 24 provide for variation in the cutting pattern according to the selected standoff distance. Generally, the initial standoff distance would be selected such that the divergent jets provide a total cut width great enough to provide clearance for the transverse extent of cutter assembly 10 (i.e. transverse to the axial extent thereof) as the cutting operation proceeds and the kerf is progressively deepened. During cutting operations selective adjustment of the standoff distance may be utilized on successive passes to progressively cut away the central ridge 103 by other jets between the illustrated diverging jets, or by cutter bit means as described hereinabove. Cutter bits, if used, would desirably be adjustable according to the standoff which has been selected.

According to the description hereinabove the present invention provides an efficient and compact hydraulic jet impingement cutter means and improved method for cutting hard formations by means of a generally elongated cutter or cutter assembly including plural, spaced apart and generally radially directed divergent jet nozzles or orifices adapted to produce plural high velocity jets of fluid cutting medium when provided with a high pressure flow of such medium from a suitable flow source. The selectively adjustable standoff distance, in conjunction with the selectively adjustable divergence of the jets offers the flexibility to set up the disclosed apparatus for an optimal cutting operation. In those cases where the parameters of the cutting operation are generally uniform, the cutter assembly of the first described embodiment hereinabove may be fabricated according to specified jet divergence, standoff distance, and other parameters to provide a jet cutter assembly for optimal cutting operations with regard to the specified uniform parameters. Thus, the selected divergence and standoff of the jets permits the cutting device to provide its own clearance as work progresses. In one embodiment the present invention provides a hydraulic jet impingement cutter capable of assembly in various configurations with varying numbers, arrangements and spacing of individually replaceable mechanical bits and jet nozzles, and further capable of having the jet nozzles individually adjusted for angle of incidence, direction and standoff with respect to the work surface.

Notwithstanding the description hereinabove of certain preferred embodiments of the invention, it is to be understood that the invention may be practiced in numerous alternative embodiments with various modifications without departing from the broad spirit and scope thereof. For example, many more nozzles 14 than shown in FIG. 1 could be included in a single, compact body 12. It is contemplated that nozzles 14 in FIG. 1, even though directed in a fixed pattern, need not be directed at angle of 90° to the longitudinal axis of body 12. For example, nozzles 14 adjacent the respective opposed longitudinal ends of body 12 could be directed longitudinally outward to cut clearance for the respective end portions of body 12 in the cutting of a closed end kerf. Bits 76 may be incorporated into or omitted from either of the cutter assembly embodiments described hereinabove, and may assume any of numerous forms such as having longitudinally opposed cutting edges whereby each bit 76 may be employed for cutting during a cutting pass in either direction. Cutter assembly 10 may furthermore include such ancillary features as a suction hose connected to a suitable suction source to remove cuttings from the kerf being worked.

These and other embodiments and modifications having been envisioned and anticipated by the inventors, it is submitted that the invention should be interpreted as broadly as permitted by the scope of the claims appended hereto.

We claim:

1. In a fluid jet cutter means for forming an elongated kerf in a formation, a nozzle means comprising: an elongated body member; said body member including a plurality of jet nozzle portions spaced longitudinally thereof and adapted to produce respective liquid jets each of sufficient intensity to free surface material from such a formation by jet impingement cutting action upon a surface portion of such formation when said jet nozzle portions are located within a maximum standoff distance from such surface portion; said nozzle means including cutter bit means spaced longitudinally of said body for cutting such surface portion of such formation; said body member being adapted to communicate with a source of high pressure liquid flow for supplying liquid cutting medium to said jet nozzle portions; said nozzle means being adapted for forming such a kerf in such hard formation by such freeing of surface material in conjunction with movement of said body member in the direction of the longitudinal extent thereof and along a path adjacent such surface portion; at least one pair of said jet nozzle portions being positioned to produce a respective pair of liquid jets directed generally transversely of the longitudinal axis of said body member and diverging radially outwardly therefrom; and the divergence of said pair of jets being of such magnitude as to permit said pair of jets to provide clearance, by such freeing of surface material, for the transverse extent of said body member and said cutter bit means during the forming of such a kerf in such hard formation.

2. A nozzle means as claimed in claim 1 wherein others of said jet nozzle portions are positioned to produce other liquid jets directed generally transversely of the longitudinal axis of said body member and within the angle of divergence defined between said one pair of jets.

3. A nozzle means as claimed in claim 2 wherein said others of said jet nozzle portions includes all of the remaining of said jet nozzle portions other than said one pair of jet nozzle portions.

4. A nozzle means as claimed in claim 2 wherein said others of said jet nozzle portions provide said other liquid jets to free surface material from said formation during the forming of such a kerf.

5. A nozzle means as claimed in claim 1 wherein the communication of said body member with such source of liquid flow is by conduit means communicating in fluid flow conducting relationship with said jet nozzle portions.

6. A nozzle means as claimed in claim 1 wherein ones of said plurality of jet nozzle portions are selectively adjustable with respect to others of said plurality of jet nozzle portions.

7. A nozzle means as claimed in claim 6 wherein said ones of said plurality of jet nozzle portions include means for selectively adjusting the standoff distance thereof from said surface portion with respect to said others of said jet nozzle portions.

8. A nozzle means as claimed in claim 6 wherein said ones of said jet nozzle portions include means for selectively adjusting the transverse orientation thereof with respect to said body member.

9. A nozzle means as claimed in claim 8 wherein said means for selectively adjusting additionally permits selective adjustment of said ones of said jet nozzle portions with respect to the longitudinal extent of said body member.

10. A nozzle means as claimed in claim 1 wherein said body member includes an elongated tubular member having interior flow passage means which communicates with ones of said jet nozzle portions.

11. A nozzle means as claimed in claim 10 wherein each of said ones of said jet nozzle portions includes a jet orifice member retained with respect to said body member by selectively releasable retention means.

12. A nozzle means as claimed in claim 1 wherein said cutter bit means additionally provides for maintaining a generally uniform standoff distance of said jet nozzle portions with respect to said surface portion of said hard formation.

13. A nozzle means as claimed in claim 1 wherein said cutter bit means is cooperable with said jet nozzle portions to free material adjacent said surface portions of said formation such that the freeing of material by said cutter bit means and said liquid jets is sufficient to form such kerf.

14. A nozzle means as claimed in claim 1 wherein said impingement cutting action of such liquid jets includes erosion of said surface portion by said liquid jets.

15. A method of cutting kerfs in a formation comprising the steps of: positioning an elongated nozzle means with the longitudinal axis thereof generally parallel to a surface of said formation in a manner to permit fluid jets provided by jet nozzle portions of said nozzle means to impinge upon said formation; supplying fluid under pressure to said nozzle means; utilizing said fluid to produce a plurality of fluid jets which diverge generally transversely of the longitudinal axis of said nozzle means and each of which impinges upon a portion of said formation to free material therefrom; in conjunction with said producing said plurality of divergent fluid jets, moving said nozzle means generally in the direction of the longitudinal extent thereof along a path while maintaining the longitudinal axis of said nozzle means generally parallel to said surface; attacking said formation with cutter bit means in conjunction with said moving said nozzle means to additional free material from said formation; and maintaining sufficient standoff distance between said nozzle means and said surface to permit said divergent jets and said cutter bit means to form in said formation a kerf at least wide enough to receive said nozzle means and said cutter bit means therein.

16. The method as claimed in claim 5 wherein said freeing of material includes erosion of material from said portions of said formation.

17. The method as claimed in claim 16 wherein said producing of fluid jets includes producing of substantially continuous flow jets.

18. The method as claimed in claim 15 wherein said positioning includes adjusting selected ones of said jet nozzle portions with respect to said nozzle means.

19. The method as claimed in claim 18 wherein said adjusting selected ones of said net nozzle portions includes selectively adjusting the standoff distance from the respective said portions of said formation of certain of said ones of said jet nozzle portions with respect to the standoff distance of other of said jet nozzle portions.

20. The method as claimed in claim 18 wherein said adjusting said selected ones of said jet nozzle portions includes selectively adjusting the angle of incidence to said formation of certain of said ones of jet nozzle portions with respect to the angle of incidence of others of said jet nozzle portions.

21. The method as claimed in claim 15 wherein said moving includes repeatedly traversing said nozzle means along said path with respect to said formation to form in said formation a progressively deepening kerf of sufficient width to receive said elongated nozzle means.

22. The method as claimed in claim 21 including the additional step of repositioning said nozzle means with respect to said formation at least once during said repeated traversing to maintain a generally uniform standoff distance between said nozzle means and said portions of said formation.

23. The method as claimed in claim 22 wherein said repositioning said nozzle means is repositioning said nozzle means with respect to the bottom of said kerf.

24. The method as claimed in claim 23 wherein said freeing of material from said portions of said formation in conjunction with said moving of said nozzle means is sufficient to progressively form said kerf.

25. The method as claimed in claim 15 wherein said positioning said nozzle means includes positioning said cutter bit means with respect to said formation in a manner to permit said attacking of said formation in conjunction with said moving said nozzle means.

26. The method as claimed in claim 25 wherein said positioning said cutter bit means with respect to said formation establishes a generally uniform standoff distance between said nozzle means and said portion of said formation.

27. The method as claimed in claim 26 wherein said moving further includes repeated traversing of said nozzle means within said path to form in said formation a progressively deepening kerf of sufficient width to receive said elongated nozzle means.

28. The method as claimed in claim 27 including the additional step of repositioning said cutter bit means with respect to said formation at least once during said repeated traversing to maintain said generally uniform standoff distance between said nozzle means and said portions of said formation.

29. The method as claimed in claim 28 wherein said repositioning said cutter bit means is repositioning said cutter bit means with respect to the bottom of said kerf.

30. The method as claimed in claim 23 or claim 29 wherein said repositioning with respect to said bottom of said kerf includes moving said elongated nozzle means into the confines of said kerf.

31. The method as claimed in claim 15 wherein said attacking said formation with said cutter bit means includes attacking other portions of said formation at locations adjacent said first mentioned portions of said formation to free material from said other portions of said formation such that said freeing of material from said first mentioned portions and from said other portions in conjunction with said moving said nozzle means is sufficient to progressively form said kerf.

* * * * *

UNITED STATES PATENT OFFICE

CERTIFICATE OF CORRECTION

PATENT NO. : 4,240,664

DATED : December 23, 1980

INVENTOR(S) : Anil Mahyera and John Duff

It is certified that error appears in the above-identified patent and that said Letters Patent are hereby corrected as shown below:

In Column 3, line 37, delete "for" and substitute --For--

In Column 5, line 14, delete "assembly 10." and substitute --assembly 10,--

In Column 9, line 16, delete "additional free" and substitute --free additional--

In Column 9, line 33, delete "net" and substitute --jet--

Signed and Sealed this

*Thirty-first* Day of *March 1981*

[SEAL]

*Attest:*

RENE D. TEGTMEYER

*Attesting Officer*

*Acting Commissioner of Patents and Trademarks*